United States Patent [19]

Otting

[11] Patent Number: 4,485,508

[45] Date of Patent: Dec. 4, 1984

[54] METHOD AND APPARATUS FOR DYEING OF TEXTILE MATERIAL

[75] Inventor: Billy J. Otting, LaFayette, Ga.

[73] Assignee: Otting International, Inc., Lafayette, Ga.

[21] Appl. No.: 469,643

[22] Filed: Feb. 25, 1983

Related U.S. Application Data

[63] Continuation-in-part of Ser. No. 391,468, Jun. 23, 1982.

[51] Int. Cl.[3] ..... D06B 1/02

[52] U.S. Cl. ..... 8/151; 8/158; 8/477; 68/205 R

[58] Field of Search ..... 8/477, 151, 158; 68/205 R

[56] References Cited

U.S. PATENT DOCUMENTS

| | | | |
|---|---|---|---|
| 3,042,573 | 7/1962 | Roberts | 8/477 X |
| 3,688,530 | 9/1972 | Harris et al. | 68/205 R |
| 3,969,780 | 7/1976 | Henderson | 8/149.1 |

*Primary Examiner*—Philip R. Coe

*Attorney, Agent, or Firm*—Kerkam, Stowell, Kondracki & Clarke

[57] ABSTRACT

A method of treating carpet and apparatus for dyeing of carpet is provided wherein a plurality of spray nozzles are disposed in a spray line transverse to the direction of movement of a carpet. Each spray nozzle is connected to a mixing chamber where air and treating liquid, preferably dye, are applied at selected pressures between 0 and 60 p.s.i. Depending on the relative pressure of the air and liquid dye, the mixture is caused to be either atomized or foamed through the spray nozzles onto the face of a moving carpet web. Each nozzle is connected to its own separate mixing chamber the input of which are controlled through a corresponding control valve which turns on and off the spray nozzle by opening and closing a corresponding gas valve and corresponding dye valve.

A method and apparatus for solid color dyeing uses a number of reciprocating spray nozzles, each spray nozzle receiving mixed dye and air from a corresponding mixing chamber and spraying the dye, which is foamed or atomized by the air, directly onto a carpet. Separate valves control the dye going into each mixing chamber and are mounted on a fluid control chamber. The field of spray width is adjustable such that different width carpets may be dyed.

17 Claims, 10 Drawing Figures

METHOD AND APPARATUS FOR DYEING OF TEXTILE MATERIAL

CROSS REFERENCE TO RELATED APPLICATIONS

The present application is a continuation-in-part application of U.S. patent application Ser. No. 391,468 filed June 23, 1982 by the present inventor and entitled "Method and Apparatus for Spray Treating Textile Material".

Valve arrangements described herein are more particularly described and claimed in U.S. patent application Ser. No. 86,392, filed Oct. 18, 1979 by the present inventor, and entitled "Pinch Tube Valve", now abandoned in favor of continuation application Ser. No. 279,954, filed July 1, 1981. The use of such valve arrangements are further are detailed in U.S. application "Jet Pattern Dyeing of Material, Particularly Carpet", Ser. No. 85,943, filed Oct. 18, 1979 by the present inventor, now abandoned in favor of Ser. No. 237,577, filed Feb. 24, 1981, now U.S. Pat. No. 4,341,098 "Pattern Dyeing of Textile Materials Such as Carpet", Ser. No. 156,624, filed June 6, 1980 by Billy Joe Ottins and Alfred Clifford, now abandoned in favor of Ser. No. 387,291, filed June 10, 1982. These aforementioned applications are assigned to the assignee of the present invention and are hereby incorporated by reference.

BACKGROUND OF THE INVENTION

This invention relates to the treating of textile material. More specifically, this invention relates to foam dyeing of textile material, such as carpets.

Numerous techniques have been used for treating or dyeing textile material such as carpet. A common technique is the well known and popular "TAK" process wherein dye is dropped or splattered onto the carpet web previously flooded with gum. This is disadvantageous in that it requires a great amount of gum, which in turn produces a large amount of effluent and necessitates a great amount of energy for steam setting the dye and for drying the carpet. Additionally, the use of a roller and doctor blade or similar types of dye applicating arrangements for applying dye and the period for drying are limiting factors in terms of the speed at which the carpet is conveyed through the system and consequently limit the rate of carpet production.

Foam dyeing represents an attempt to overcome several of the above-mentioned disadvantages common to most dyeing processes. Although various foam dyeing techniques have been generally useful in avoiding several of the disadvantages associated with conventional dyeing techniques, they are often limited to the production of patterns having random dyeing affects. Generally, such techniques have been unsuitable for patterns requiring sharp resolution for intricate or detailed patterns. Further, the requirement for adding relatively large quantities of foam generators and foam stabilizers adds to the production costs of such techniques. Additionally, most foam dyeing requires pumping foam from remote foam generators which are disadvantageous not only because the foam must have stabilizers to prevent its dissipation when it is pumped, but because it is more difficult to change colors or achieve add on when the foam is then sported over long distances via a pipe or tube. The flow of foam in such systems requires dumping of all foam left in the tube resulting in costly wastage.

Some years ago foam dyeing was introduced for batch dyeing piece goods. The purpose of the process was to carry out aqueous dyeing with the very minimum use of water, and initial attempts utilized as little as 1:1 volume ratios and less. However, equal parts of water neither fully nor uniformly wet out fabric. As a result the idea of spreading the effective surface area of the water by creating foam bubbles was developed. The dye solution containing a foam surfactant was applied to the fabric under nonfixation conditions, followed by the mechanical action of running the fabric. The foam which developed served to move the dye throughout all the fibers prior to reaching fixation conditions. After uniform distribution of the dye was achieved, hot air was introduced to raise the temperature for fixation. This process, in effect, was the forerunner of the foam dyeing which is seen today.

Foam dyeing presents several advantages over conventional techniques. Four to five hundred percent dye pickup is possible in the continuous foam dyeing of carpet, and while there is some controversy about the amount of foam pickup required to produce a satisfactory dyeing, there is no doubt about the fact that considerably less water must be heated in the steamer when applying dye with foam. Even if as much as 200% pickup is used, a minimum 50% reduction in energy demand is achieved for heating the dyebath which has been placed on the carpet. On the basis of requirements of 1 Btu per degree per pound of water, a change from five pounds to two pounds of water pickup per pound of carpet represents a decrease from 650 to 260 Btu per pound of carpet to heat the water to 212° F. Thus, steam consumption for heating the dyebath on carpet weighing two pounds per square yard would be reduced from 6,336 pounds to 2,495 pounds per hour if linear speed were 60 feet per minute.

Substantial increases in carpet productivity can be achieved since carpet lines can be constructed to operate at 100 feet per minute and more. Existing lines to which foam applications have been added have been speeded up to 60 feet per minute. When this is measured against 30 to 40 feet per minute on the average line currently in place, the productivity advantages for foam ranges are enormous.

It has been found that full penetration of acid dye into the fiber filament can be achieved in about two and one-half to three minutes in an atmospheric steamer. Thus, existing 80 meter loop steamers or 200 foot horizontal steamers can easily handle the higher running speeds.

The most rapid speeds are made possible partially because lower wet pickup provides more rapid heat-up to dyeing temperatures, as well as easier washing requirements due to the elimination of gums.

The firm body produced by many foam systems has eliminated the need to use gums to increase bath viscosity. This is a significant cost saving. The firmness of the foam can be varied to suit any particular purpose simply by increasing the blow ratio or by adding foam stabilizers. In the latter, a small amount of gum will significantly increase firmness. Higher concentrations of chemicals ore more mechanical action will also develop greater foam stability.

Gums are frequently used to create styling effects such as those achieved with gum layers, and here again similar styling effects are being achieved with foam.

The cost savings generated by using air to replace gums are obvious.

Substantial savings in dye costs can result from foam systems. The cost reduction occurs because all of the dye applied is fully utilized. Existing methods of dye application frequently allow considerable losses, due to run-off resulting from the high pickups which are used. Excess dye and residuals in pipes and tanks are also minimized. It has been proven in practice that there is as much as a 10 to 15% reduction in dye cost when dyeing solid colors and even more when dyeing multicolor. When foam systems are used for dyeing, savings in rinse water are also seen. This is because gums have been eliminated and all the dye has been fully fixed. Rather than full immersion washers with various types of mechanical agitation, simple sprays and vacuum extractors appear to be all that is needed. Therefore, the reduced water load represents good water conservation practice as well as an economic advantage.

While waste steam reduction may not be a significant factor at all locations, it will certainly be more of a concern in the future. By using foam for carpet dyeing, the waste stream is reduced considerably in volume, and treatments related to gum disposal and excessive dye runoff are eliminated. Mills now paying tax on every gallon of wastewater entering the sewage stream will certainly appreciate saving this nonproductive cost. And as discussed in the discussion on washing, the use of foam to replace fluid water for washing again cuts the waste stream considerably.

Any fluid system containing dye, whether it be water, foam or solvent, must be applied uniformly to the fabric, both side-to-side and end-to-end. Whatever mechanical device is used, it must deposit the fluid uniformly. In point of fact, the method of applying foam is the key difference between the several foam dyeing machines being promoted today. Foam prepared for deposition onto fabric should be uniform. Every liter must contain exactly the same amount of dye to insure uniform dyeing.

The preparation of uniform foam depends on delivering exactly constant quantities of dye solution and air to be mechanically blended to a uniform product. The blow ratio, or specific gravity, of the foam is a controlling factor, and must remain constant throughout the run.

Two known systems used to externally generate foam include the rotary mixer and the static generator. The former delivers both air and dye liquor to the foam generator in precisely metered amounts, thence through a hose to the point of use. The degree of mechanical action in the foam head determines the consistency of the foam, large or small bubbles, stiff or loose foam. The pressure which is generated in the foam head must be reduced to atmospheric pressure at the point of delivery, and this is largely controlled by the length of delivery hose.

The static foamer does not build any significant pressure, and uniformity of dye being delivered as foam is controlled by precise metering of the prepared dye solution. Air is delivered under a fixed pressure which automatically provides the desired blow ratio and bubble size.

The two described systems of generating foam for dyeing are external foam generating systems. Another type of foam generating system may be described as an in-situ foam generators. In one known in-situ method air jets within a trough of dye create the foam simply by blowing through the dyebath containing a foaming chemical. Delivery of dye is controlled by maintaining a constant level of dyebath in the dye trough. A constant feed of air to the trough then controls the amount of foam which is generated, and thus delivery of dye to the fabric. The present invention relates to in-situ foam generation wherein foam is produced by mixing air and dye solution at the spray nozzle through a jet. A fine foam in the form of a spray is delivered to the fabric as it passes under the jets. By varying air pressure, penetration and coverage can be changed. By varying the quantity of dye delivered, add-on can be controlled.

What is believed to be one of the first successful use of foam for dyeing carpets was by Galaxy Carpets of Dalton, Ga., to produce multicolor designs. The method used was the patented system developed by United Merchants & Manufacturers, Inc., described in U.S. Pat. No. 4,282,729. In this patent, foam is generated externally using a rotary head mixer then delivered through a pipe (21) to the trough (10). At points 22 and 23, concentrated dye is injected into the foam stream. As the foam is delivered at point 24, it falls onto the triangular shaped disc (30). The disc makes a rotating motion as the whole assembly traverses the width of the carpet, creating a foam/dye reservoir. The injected foam can be either clear or colored and the shape of the distribution disc can be changed, with each modification creating a different pattern effect. More dye streams can be injected into the foam stream to give greater color variation if desired. The foam blade can be raised or lowered to control the amount of foam left on the carpet face.

Following application, the foam is immediately collapsed by vacuum. A light nip roll section follows to even out any dye fluid nonuniformities, particularly at the selvages, and to provide a pulling action on the carpet. Steam fixation, washing and drying complete the operation.

Kusters is a manufacturer which has been active in continuous carpet dyeing equipment since 1967. In the Kusters machine, foam is generated externally and piped to a reservoir where it is doctored onto the carpet applicator roll. The film of foam is accurately metered onto the roll through an adjustable gap in the bottom of the foam box. This apparatus is described in U.S. Pat. No. 4,275,683.

It is a general object of the present invention to provide a new and improved method and apparatus for foam dyeing of textile material.

Another object of the present invention is to provide for the dyeing of textile material with a relatively low amount of water and energy consumption.

A further object of the present invention is to provide for the dyeing of textile materials with only a minimal amount of effluent produced.

A still further object of the present invention is to provide for the dyeing of textile materials with sharp patterns having a high degree of resolution.

Yet another object of the present invention is to provide for the dyeing of textile materials wherein the dye is used in a highly efficient manner with very little of the dye wasted.

Another object of the present invention is to minimize the drying time of a dyeing process so as to allow an increased rate of production.

Yet another object of the present invention is to provide for the dyeing of textile materials with patterns which may be changed very quickly.

A still further object of the present invention is to provide solid color dyeing wherein color changeover can be accomplished with minimum waste of dye liquor.

Still another object of the present invention is to provide an improved method and apparatus for foam dyeing of carpet.

SUMMARY OF THE INVENTION

These and other objects of the present invention, which will become apparent as the description proceeds, are realized by a method and apparatus for treating textile webs wherein dye liquid and air are applied at preselected pressures into a mixing chamber adjacent the spray nozzle. Depending on the relative pressures of the liquid and air, the mixture is caused to be atomized or foamed through the nozzle onto the pile face of the textile web. A plurality of nozzles, each with its own mixing chamber, are spaced above and across the face of the web so that the entire width of the web is treated as the web is conveyed past the nozzles. Each chamber is independently valved such that high pattern resolution may be achieved and a plurality of such treating stations may be successively arranged along the path of travel of the carpet web.

More specifically, the present method of treating a continuously moving textile web comprises the steps of: conveying the web past at least one treating station; mixing gas and treating liquid in a plurality of separate mixing chambers disposed at the treating station; and spraying the mixed gas and liquid onto the web through a plurality of spray nozzles disposed at the treating station and corresponding on a one-to-one basis with the plurality of mixing chambers, and each spray nozzle spraying the mixed gas and treating liquid of the corresponding mixing chamber. The mixed gas and treating liquid exits from each spray nozzle within two and a half inches of its corresponding mixing chamber such that mixing is done in situ and a fine foam in the form of a spray is delivered to the pile face of the web as it passes under the jets.

The method further includes the step of reciprocating the spray nozzles while the rinse foam is sprayed onto the pile face as it moves. The treating liquid is preferably a dye. The method further includes controlling a plurality of dye valves to allow dye to flow to the plurality of mixing chambers, and wherein there is one dye valve for each mixing chamber and the opening of the plurality of dye valves is accomplished simultaneously by controlling a control fluid pressure in a control fluid chamber. Further, the method includes reciprocating the plurality of mixing chambers, and a plurality of spray nozzles may be arranged in at least two rows with each of the two rows being reciprocated in different phases.

Apparatus for treating a continuously moving textile web in accordance with the present application comprises: a plurality of valves, a plurality of mixing chambers, each mixing chamber connected to corresponding valves for receiving gas and liquid respectively and for mixing the gas and the liquid; a plurality of spray nozzles each connected to a corresponding one of the mixing chambers for causing a fine foam in the form of a spray to be applied onto the textile web. Reciprocating means may be provided for reciprocating the spray nozzles. The plurality of valves are fluid pressure control valves and are mounted on an external wall of a fluid control chamber. Each valve is controlled by the pressure of a control fluid in a control chamber. The apparatus includes an internal cylindrical wall means at least partly within the control fluid chamber for isolating a selected number, preferably a minority, of the valves from the control fluid pressure and likewise controls a selected majority of the valves. The selected majority of the valves are open, while the remaining minority of valves are closed to cause a relatively narrow width of textile web to be treated. All of the valves are opened for treating a relatively wide textile web.

The reciprocating means causes the mixing chambers to reciprocate and includes two reciprocating members arranged such that each of the spray nozzles is mounted to one of the two reciprocating members. A support surface means underlies at least a portion of each of the reciprocating members for supporting the reciprocating members above a continuously moving textile web, and upper guide means disposed above at least part of the two reciprocating members cooperate with the support surface means to hold the two reciprocating members against vertical movement. Linear polyethylene bearing portions bear the relative movements as the two reciprocating members reciprocate.

The external wall is cylindrical and the internal wall includes a cylindrical portion and an annular seal at one end to establish an annular minority control zone between the cylindrical portion and the cylindrical external wall. A majority inlet port allows the inputting of control fluid to the control fluid chamber for controlling the majority of valves and a minority inlet port allows for inputting control fluid to the minority control zone. The majority control port is a hole or channel in the cylindrical portion arranged to communicate with a source of pressure and the cylindrical portion is hollow such that control fluid flows from the majority control port through the hollow cylindrical portion to control the majority of the valves.

The subject invention uses foam dyeing where foam is not generated as a separate step but produces it at spray nozzles mounted directly above the carpet. Dye solution and air are mixed at the specially designed nozzle so that foam is sprayed onto the carpet. It quickly penetrates the tufts and dissipates within a few seconds.

The jets are mounted on half-inch centers across the width of the carpet with one color per station, with each station able to deliver about 50% pickup. While as many individual stations as desired can be used, existing units have three. The on/off flow from each jet is controlled by a black and clear pattern on acetate or Mylar film, which can be changed within seconds. The pattern film can be run at varying speeds to produce different effects. The reverse image design can also be used to produce still a different pattern.

The frame holding the jets can oscillate to produce additional design, and the spray heads themselves can also be changed to give other variations; i.e. circular, oval, etc.

The flow of dye and air is adjustable by hand knobs and readout gauges. The usual blow ratio is about 4:1 and is achieved with about ten pounds pressure on each gauge. Increased stream velocity and flow are obtained at the same blow ratio by raising both pressures equally. Increased blow ratio is achieved by increasing only the air pressure. Lower pressures give less flow volume and are used to produce surface effects.

Foam can be applied to either dry or pre-wetout carpet. If desired, the wetout bath can contain dye to give a ground shade as a fourth color. Fourth generation nylon styles require a pre-wetout.

Solid colors as well as patterns can be dyed on the subject foam unit, and it appears to be a highly versatile machine. The simplified control method is very impressive. In addition to the unit for patterns and multicolors, a nozzle station for producing only solid colors may be provided. It contains two rows of nozzles and avoids the sophisticated controls used with pattern machines. As a result it is considerably lower cost if only solid colors are desired.

BRIEF DESCRIPTION OF THE DRAWINGS

These and other features of the present invention will be best understood when considered in conjunction with the accompanying drawings wherein like characters represent like parts throughout and.

DETAILED DESCRIPTION OF THE PREFERRED EMBODIMENTS

PATTERN DESIGN APPARATUS

Figure 1:
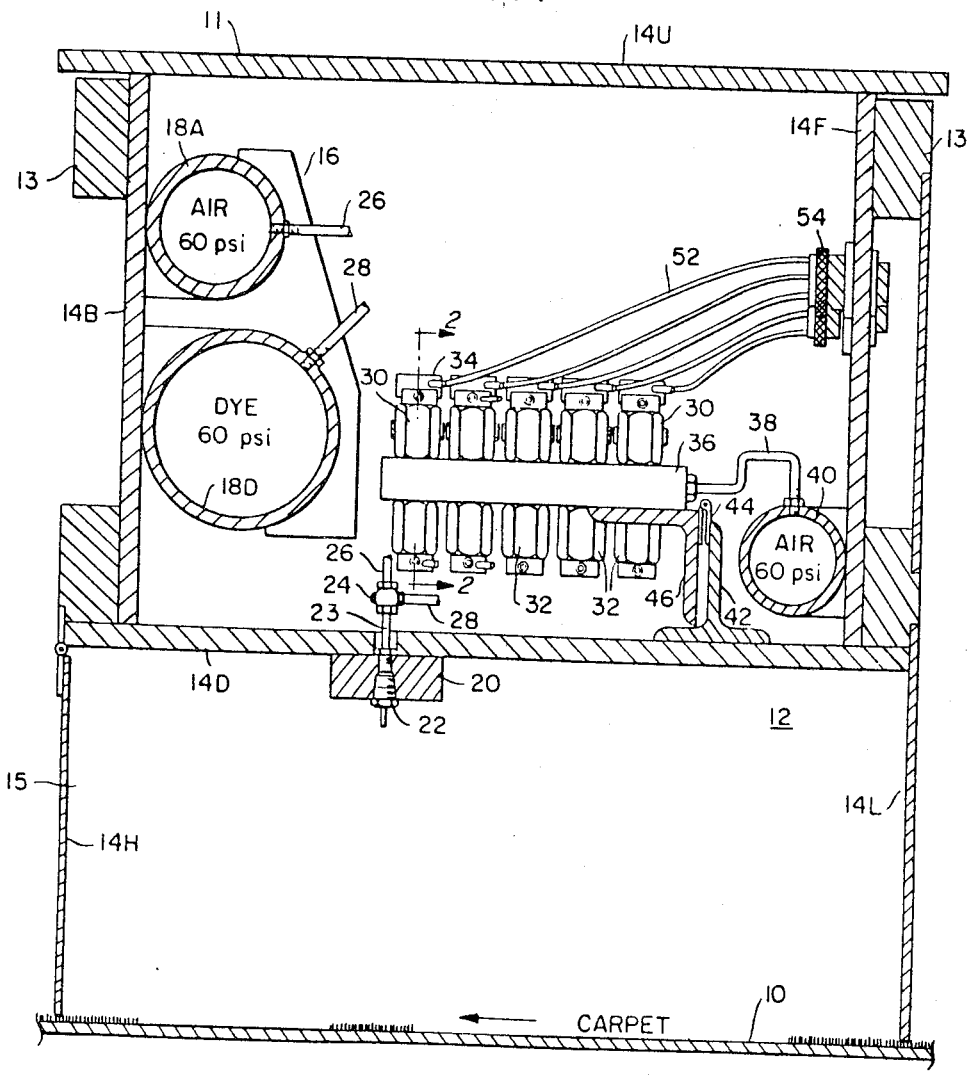
FIG. 1 shows a cross section side view of a first embodiment of the present invention with several parts shown in cross section.
Figure 2:
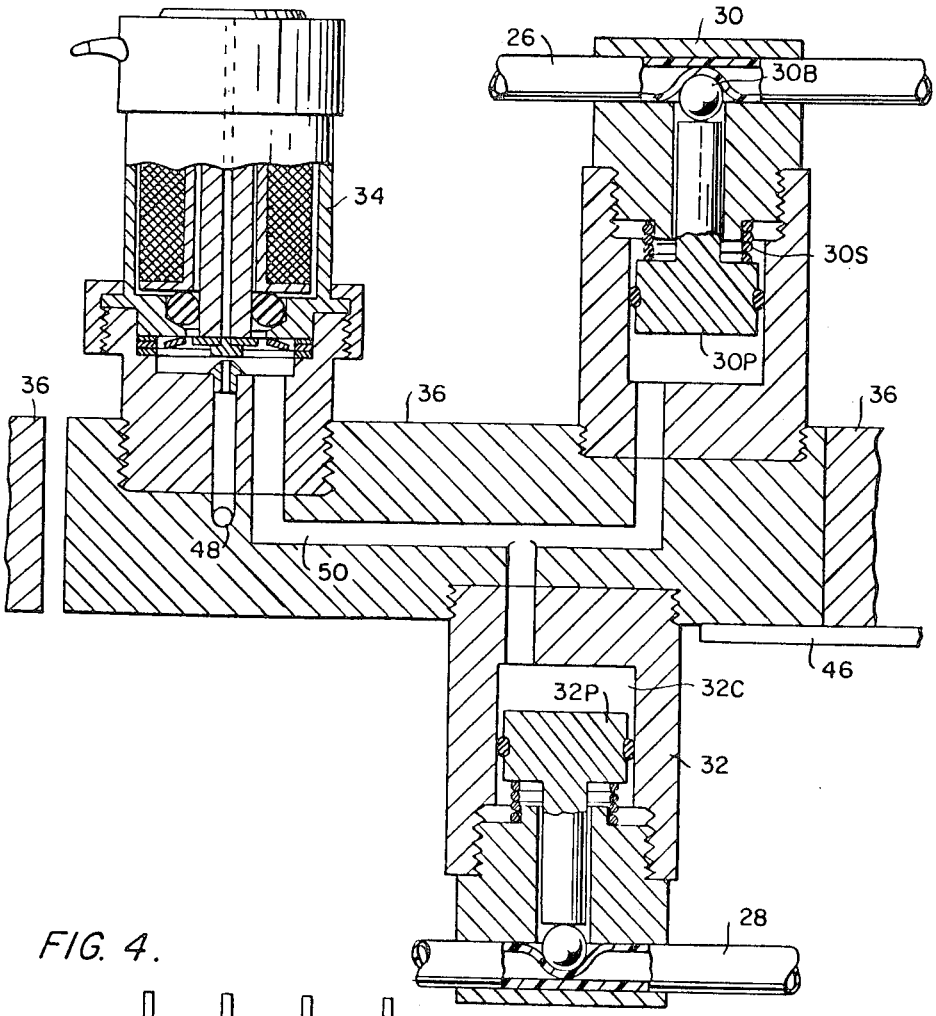
FIG. 2 shows a cross section view along lines 2—2 of FIG. 1.

Turning now to FIGS. 1 and 2, a first embodiment of the present invention will be discussed. FIG. 1 shows a side view of the present invention with several parts shown in cross section, whereas FIG. 2 shows a cross section view taken along lines 2—2 of FIG. 1 to illustrate operation of various valves used with the present invention.

A carpet 10 moves in the direction shown below a dyeing station 12 according to the present invention. It will be readily appreciated that a dyeing station similar to 12 may be located either upstream or downstream from 12 to dye the carpet with a different color, thereby attaining multi-color effects. Since such other dye stations will be identical in construction to dye station 12 except that it will be supplied with a different color dye, it obviously need not be discussed in detail.

More generally, dye station 12 could be a treating station in which case spray liquids other than dye could be used. For example, gums or other substances used for treating textiles may be employed in place of, or in addition to, dye. Since the present invention is especially well-suited to dyeing the discussion which follows will emphasize the use of dye as the spray liquid.

It will also be appreciated, that dyeing station 12 extends transversely of the width of a carpet web driven continuously through several treating stations of a conventional carpet dyeing system. Web 10 may, for example, be fifteen feet in width and is subjected to several treating steps during the process, all of which are well known.

The dye station 12, according to the present invention, includes an applicator head having upper, lower, front, and back walls labeled 14U, 14D, 14F and 14B respectively. Corner blocks 13 as shown and bolts (not shown) may be used to hold the walls together and provide additional rigidity to the structure. Additionally, a lower wall 14L and lower hinged wall or skirt 14H are situated as shown to define a closed area 15 between the carpet and application head. If desired side skirts, not shown, may also be included to completely enclose the area over the carpet and application head. Support 16 is attached to wall 14B for supporting a pressurized air source reservoir 18A and pressurized dye source reservoir 18D, each of which is generally cylindrical extending perpendicular to the plane of the view of FIG. 1, i.e. transverse to the direction of travel of the carpet web 10.

A spray nozzle support block 20, which is rectangular in cross section as shown and extends across the width of the carpet web is mounted to the underside of lower wall 14D and supports spray nozzles 22. Although only one spray nozzle is shown in FIG. 1, it is to be understood that a number of identical spray nozzles 22 will extend in a line perpendicular to the plane of the view of FIG. 1 and transverse to the direction of travel of the carpet web. Preferably, the center-to-center distance between adjacent spray nozzles 22 threaded into block 20 is one-half inch. Each of the spray nozzles 22 is connected to a mixing zone or chamber 24 by a connector tube 23 and each chamber 24 is in turn connected to a flexible gas supply tube 28. The interior of mixing chamber 24 may be a simple parallelepiped with exterior access holes, or nipples allowing connection of tubes 23, 26 and 28 dye and air in and the mixture of dye and air out. The chamber could, for example, be about a $\frac{1}{2}''$ cube. For simplicity's sake, gas or air supply tube 26 and the dye supply 28 are broken away. All of the mixing chambers 24, air supply tubes 26, and dye tubes 28 will be disposed within the applicator head 11. For a 15 foot width head one can readily appreciate that interconnecting 260 mixing chambers 26 requires an enormous amount of tubing to be confined within the walls defining the head. As shown, the air tubes 26 are connected to the air reservoir 18A, whereas the dye tubes 28 are connected to the dye reservoirs 18D.

Each of the air tubes 26, which is associated with a corresponding one of mixing zone 24 and a corresponding one of spray nozzle 22, with a corresponding one of air or gas valves 30. Likewise, each of the dye tubes 28 is associated on a one-to-one basis with a mixing zone 24 and a corresponding spray nozzle 22, and also corresponds on a one-to-one basis with a control valve 34. Thus, each associated gas valve 30, dye valve 32 and control valve 34 forms a valve control set as show in FIG. 1, five such control sets of corresponding valves 30, dye valves 32, and control valves 34 are mounted to an individual support member block 36 forming a modular unit. A number of such identically constructed modular support member blocks 36 are supported interiorly on applicator head 17 on cross bracket 46. Each of the support member blocks 36 have interior fluid channels adapted to be connected to a control fluid source or reservoir 40 by way of tube 38. The control fluid may be air at 60 p.s.i. pressure for example. If the air reservoir 18A which is used for spraying the dye is of the same pressure, then the tube 38 may simply connect to cylinder 18A. Alternately, a compressor or other source of pressurized air for control fluid tube 40 may simply be the same source of pressurized air which supplies 18A.

Each of the support member blocks 36 is mounted to a support bracket 46 which is connected by hinge 44 to mounting piece 42. Each of the numerous support member blocks 36 may have a separate support bracket 46 or, alternately, as shown in FIG. 2, two adjacent support member blocks 36 may be supported by the same bracket 46. The mounting piece 42 may simply extend along the full axial length of the applicator head 11 parallel adjacent the line of spray nozzles 22. The actual location is selected to minimize the length of connecting tubes.

As best shown in FIG. 2, the control fluid air which enters the support member block 36 through tube 38 is distributed to the associated five control valves 34 by a control fluid passage 48. Depending upon whether the solenoid of control valve 34 is actuated, control fluid may either be blocked or flow through a particular control valve 34 into the corresponding gas valve 30 and corresponding dye valve 32 by way of control fluid passage 50. There would, of course, be five control fluid passages 50 in each support member 36 corresponding to each set of a gas valve 30, a dye valve 32, and a control valve 34.

The operation of the valves such as the gas valves and each dye valve 32 is discussed in detail in the above-identified and incorporated by reference patent application Ser. No. 279,954. However, the operation of a gas valve 30 will be briefly discussed herein, it being understood that each of the dye valves 32 functions in the same manner. When the solenoid valve 34 is actuated, control fluid such as pressurized air is allowed to flow from passage 48 into passage 50 and into valve chambers 30C and 32C. The piston 30P will be displaced agaist the bias of spring 30S. This will cause the freely rotating ball 30B to squeeze the flexible gas tube 26, thereby cutting off flow of gas into the corresponding mixing chamber 24. In similar fashion, the presence of pressurized control fluid in chamber 32C will act on piston 32P simultaneously cutting off the flow of dye to the corresponding mixing chamber 24 by pinching the flexible dye tube 28. Obviously, this will in turn cut off the spray output of the corresponding spray nozzle 22.

Each of the solenoid control valves 34 is turned on and off by electrical signals on lines 52 connected to an external signals on lines 52 connected to an external control via plug 54 mounted in fron wall 14F. A single lug 54 may be used to interconnect all five of the solenoid control valves 34 on a particular modular support member block 36.

Figure 4:
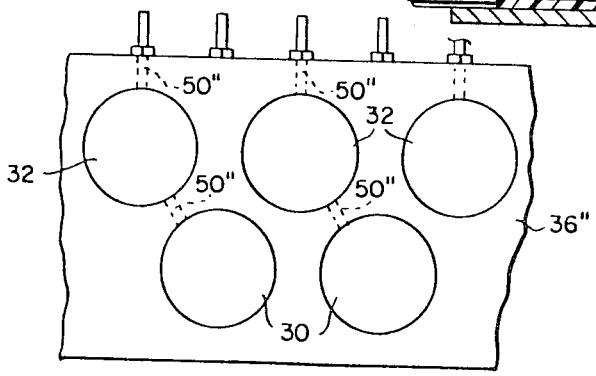
FIG. 4 shows a view along lines 4—4 of FIG. 3, but with a slight modification to parts of FIG. 3.
Figure 3:
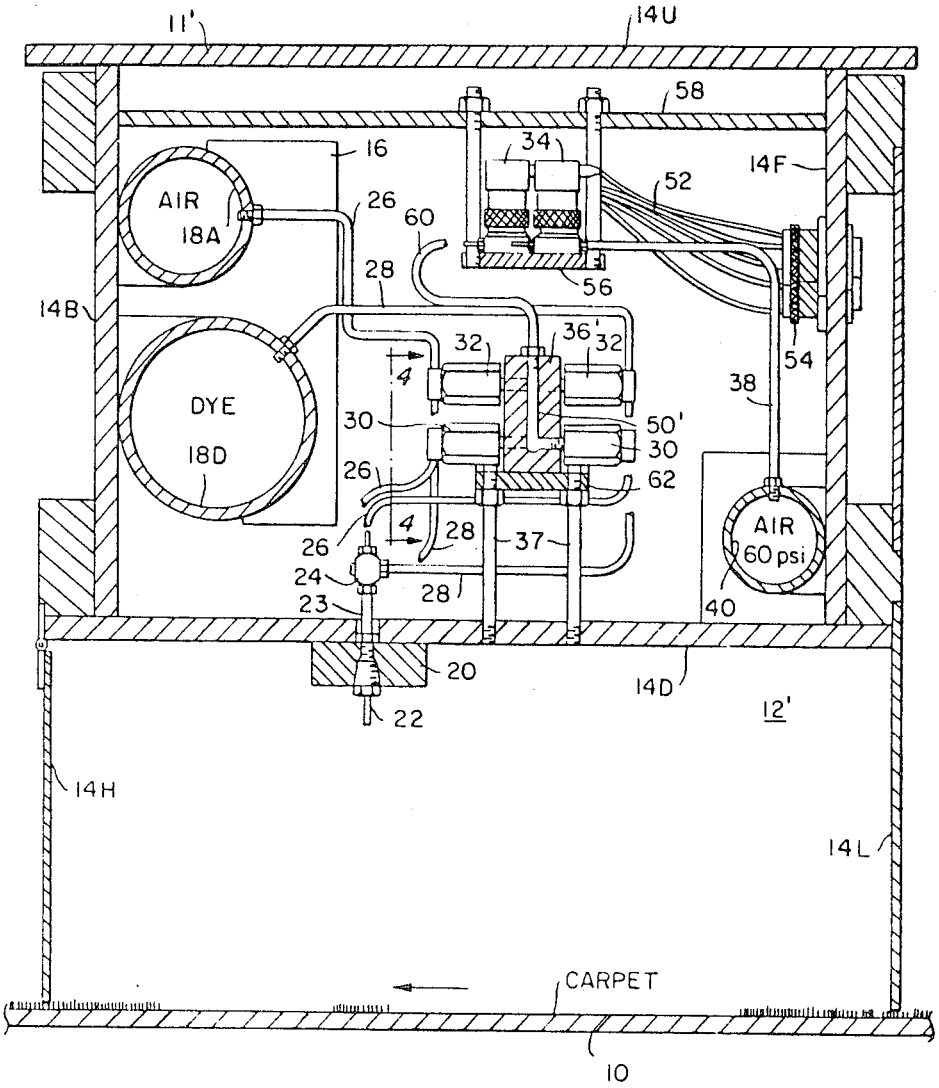
FIG. 3 shows an alternate embodiment of the present invention with several parts shown in cross section.

Turning now to FIGS. 3 and 4, an alternate embodiment of the present invention will be discussed. FIG. 3 shows a side view of an alternate embodiment of the present invention, whereas FIG. 4 shows a view taken along lines 4–4 of FIG. 3 with a slight modification to support member block 36'. This alternate embodiment of a dyeing station 12' and applicator head 11' according to the present invention includes numerous components which function in exactly the same fashion as with the embodiment of FIGS. 1 and 2 and which, therefore, need not be described again. The dyeing station 12' and applicator head 11' are identical to the dyeing station 12 and head 11 except for the placement and support for gas valves 30, dye valves 32, and control valves 34.

In the embodiment of FIG. 3, the solenoid control valves 34 are disposed side-by-side in two rows upon a support plate 56 which is bolted to a support wall 58 as shown. The support wall 58 may be bolted or otherwise affixed to front and back walls 14F and 14B. A control fluid tube 60 extends from each of the solenoids 34 to support member block 36'.

The support member block 36' is mounted upon a support plate 62 which is bolted to the wall 14D by upstanding cornerposts 37. Support member block 36' which may extend substantially along the full span of the spray nozzles 22 or alternately constructed to comprise a number of similar modular blocks arranged in a line extending the length of applicator head 11', includes a number of control fluid passages 50'. The control fluid passages 50' operate in the same manner as the control fluid passages 50 for the embodiment of FIGS. 1 and 2. In particular, control fluid from the solenoid 34 flows to the corresponding gas valve 30 and dye valve 32 by way of control fluid tube 60 and control fluid passage 50'.

As shown in FIG. 3, a particular gas valve 30 may be situated directly below the corresponding dye valve 32. In that case, the control fluid passage 50' extends vertically downward and horizontal to the right to provide the pressurized control fluid air to the valves 30 and 32. The valve 30 and 32 mounted on the left side (as seen in FIG. 3) of the support member block 36' may be supplied with air by a passage similar to 50' except that it leads off to the left as shown in pahntom lines in the view of FIG. 3. By mounting valves 30 and 32 on both sides of the support member block 36', a large number of the valves may be accomodated to correspond to each of the spray nozzles 22 extending across the width of the travelling carpet web. Thus, if the center to center distance of nozzles 22 were reduced to ¼ inch, block 36, would readily support the additionally required valves.

A slight modification of the support member block 36' may be seen in FIG. 4 which shows a support member block 56'' wherein the gas valves 30 and corresponding dye valves 32 are staggered to accomodate more valves in a given amount of space. In this case, the control fluid passages 50'' may lead vertically down to a particular dye valve 32 and then slant to supply control fluid to the corresponding gas valve 30. For simplicity's sake, the valves 30 and valves 32 are shown in schematic form only. Similarly, only the control fluid passages 50'' associated with valves on the back (i.e., the view of FIG. 4) are shown, it being readily understood that similar control fluid passages 50'' would be sued for valves 30 and 32 mounted to the front of the support member block 36''.

Although the pattern dyeing method and apparatus of the present invention uses gas valves 30, a simplified version might delete valves 30 and continuously supply air to the mixing chambers 24, gating only the dye flow by valves 32.

PATTERN DYEING OPERATION

The operation of the present invention for pattern dyeing will presently be discussed. The carpet 10 is driven in the direction of the arrow in a continuous fashion by means which are well known in the art. The spray nozzles 22 stand in a spray line perpendicular to the direction of movement of the carpet 10 about six inches above the base of the carpet web 10. In particular, a pattern controller, digital computer, or similar means well known in the art is used to control actuation of the solenoid control valves 34 which in turn cause the corresponding gas valves 30 and dye valve 32 to be controlled. When the gas valve 30 and dye valve 32 corresponding to a particular spray nozzle 22 are actuated by the control valve 34, gas, which may be air as shown, and dye are mixed together in the particular mixing chamber 24 corresponding to that spray nozzle 22. The air flowing into the mixing zone 24 by way of air or gas tube 26 tends to atomize or break up the dye flowing into the air mixing chamber 24 by dye tube 28. As shown in the drawings, the air is supplied into the mixing chamber in the same direction as the mixed air and dye is sprayed out of the spray nozzle. The dye is supplied into mixing chamber 24 perpendicular to the output of the mixture of dye and air. If desired, the mixing chamber 24 and corresponding spray nozzle 22 may be integral.

If the pattern controller indicates that a particular spray nozzle 22 is to be turned off, the corresponding solenoid control valve 54 may be actuated to allow control fluid to pass into the control fluid passage 50 (or 50' or 50'') to cause the corresponding flexible tubes 26 and 28 corresponding to a particular spray nozzle 22 will then readily cut off the spray of dye out of that spray nozzle.

In carrying out the method of the present invention, various pressure combinations for the air and dye used in spraying the dye may be used to achieve varying results. A range of 0 p.s.i. to 60 p.s.i. for both air and dye is acceptable with 12 p.s.i. of dye to 24 p.s.i. of air providing a mist or atomized output from the mixing chamber. A ratio of approximately 4:1 in dye pressure to air pressure will cause bubbles to be formed yielding a foam out of the mixing chamber. A ratio of 17 p.s.i. of dye to 15 p.s.i. of air works well. Care should be taken to avoid great differentials between the dye pressure and air pressure. On some models a differential of greater than 7 p.s.i. may result in dye flowing out of the mixing chambers into air tubes. Most importantly, the present invention does not require the addition of water or significant amounts of organic solvents to the dye to achieve foaming. The present invention does not require the addition of numerous foam generator and/or foam stabilizer chemicals as is common among foam dyeing techniques, although one could add such chemicals if desired.

In the case of producing a fine mist, the side skirts act as a shield to confine the mist from being carried away by local drafts. However, such misting does not cause serious problems as in actual practice users prefer to operate without the skirts since downward application of the atomized mixture or foam, depending on pressures selected, causes direct application of the materials to the pile face of the carpet web in a well controlled fashion to allow selective pattern formation.

Following the application of the dye onto the pile face, the carpet is passed into a steamer (not shown) where the dye may be fixed into the carpet yarns most advantageously and in lesser amounts than heretofore required, because the dye can be applied directly without a gum carrier. A considerable energy saving is effected since less steam is needed than in prior art processes which use gum, resins, or other carriers. Such carriers commonly must be heated to reduce their viscosity and permit them to be washed away. Further, the minimal use of such gums and other substances in the present invention means that less water is used in the washer or washing stage (not shown) which typically follows the steamer. Since less water is used in the washing stage, the amount of heat energy required in the subsequent drying stage (not shown), is also reduced.

An important advantage of the present invention is that a pick up of between 110 and 130% is realized as compared to, for example, a normal TAK dyeing process which has required between 350 and 500% pick up. Even lower pickup figures may be realized by the present invention depending upon operational settings. "Pick up" as used herein refers to the ratio of dye to the weight of carpet in percent to achieve dyeing. For example, if 60 oz. of dye are applied to 30 oz. of carpet, the pick up would be $60/30\times100=2\times100=200\%$ pick up. A lower pick up is advantageous and is indicative of using less dye for a given weight carpet. The present invention is therefore more efficient in its use of dye in addition to its advantageous minimization of energy consumption.

SOLID COLOR APPARATUS

Figure 5:
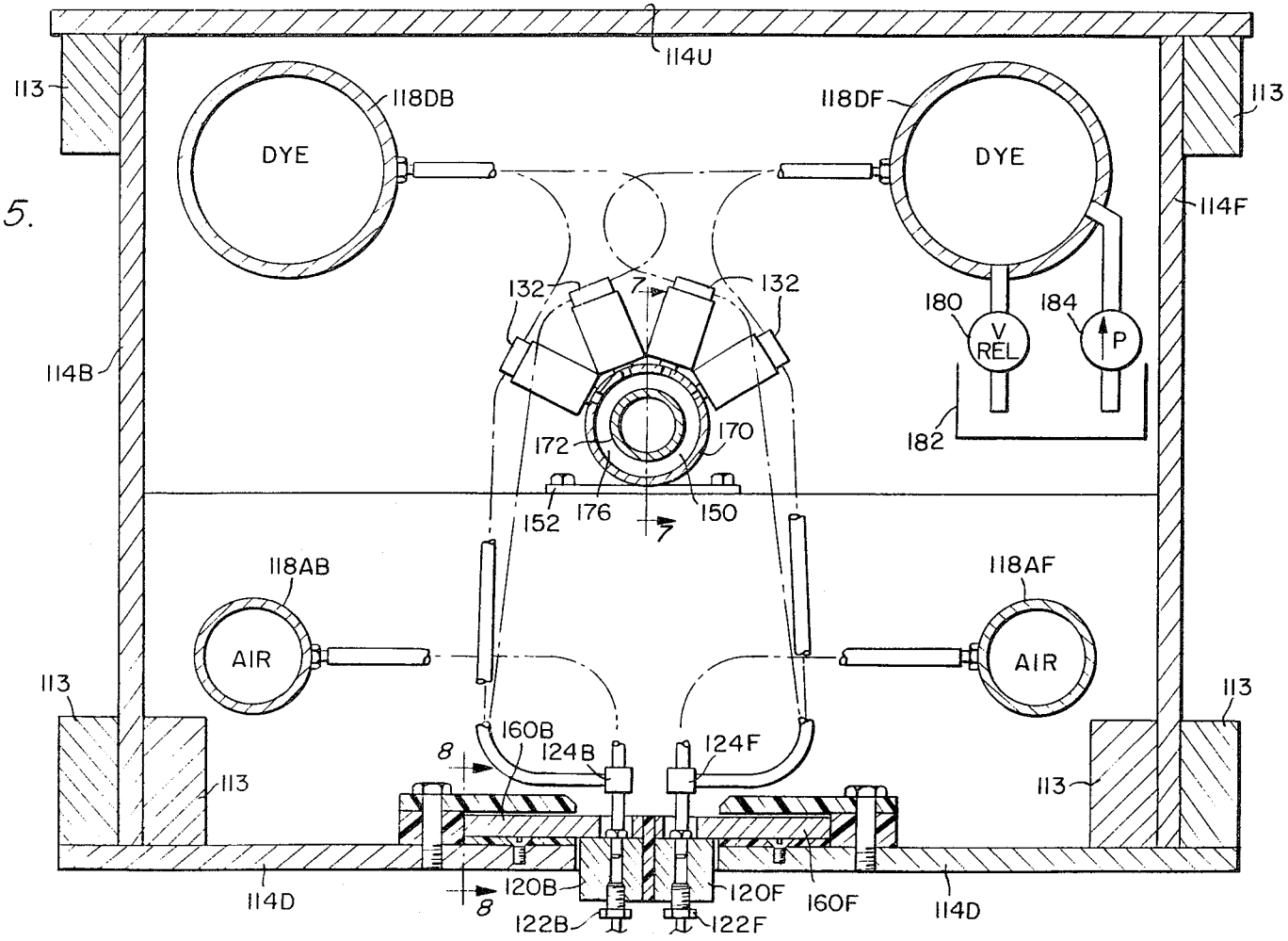
FIG. 5 shows a cross section side view of another embodiment of the present invention.

Turning now to FIG. 5, a cross section side view of a solid color dyeing apparatus of the present invention is shown. The front and back walls 114F and **114*b*, the upper and lower walls 114U and 114D, and blocks 113 all function in similar fashion to the corresponding parts labeled in FIG. 1. The parts of FIG. 5 are labeled in the 100 series with the same last two digits as the corresponding part in FIG. 1. Likewise, front and back dye tubes 118DF and 118DB function in similar fashion to dye conduit 18D of FIG. 1, whereas front and back air tubes or conduits 118AF and 118AB function in similar fashion to air conduit 18A of FIG. 1**.

The basic structure of the FIG. 5 embodiment is similar to the FIG. 1 embodiment. The dye conduit tubes 118DF and 118DB and the air tubes 118AF and 118AB are cylindrical tubes with their access perpendicular to the plane of FIG. 5. The FIG. 5 embodiment is different than the FIG. 1 embodiment in that the valving system is somewhat simplified since this embodiment is not adapted to produce patterns. One simplification is that there is no need for separate control of each of the spray nozzles 122F and 122B. Accordingly, all of the dye valves 132 are controlled by a common fluid control chamber 150 which is a cylinder having its axis perpendicular to the plane of FIG. 5. The fluid control chamber 150 is mounted on a support 152 which is secured to an end wall (not shown) extending between front and back walls 114F and 114B. A further simplification of the valving system for the embodiment of FIG. 5 has the pressurized air from air conduits 118AF and 118AB proceeding directly into the corresponding front and back mixing chambers 124F and 124B. Although one could valve the air going into the mixing chamber in similar fashion to the valving of the air in the FIG. 1 embodiment, it is preferred to simply let the pressurized air flow into the mixing chambers 124F and 124B directly.

In similar fashion to the nozzle arrangement of FIG. 1, front and back nozzles 122F and 122B respectively represent a row of nozzles which extend perpendicular to the plane of view of FIG. 5. However, unlike the stationary arrangement of FIG. 1, the nozzles 122F and 122B are mounted for reciprocation perpendicular to the plane of FIG. 5. In particular, the front row of spray nozzles 122F are mounted on a front reciprocating member 160F by way of support block 120F, whereas the back row of reciprocating spray nozzles 122B are mounted upon a back reciprocating member 160B by way of support block 120B.

As with the FIG. 1 embodiment, carpet (not shown in FIG. 5) would be moving under the spray nozzles 122F and 122B from front to back (right to left in the view of FIG. 5). As with the embodiment of FIG. 1, spray skirts such as 14L and 14H could be used.

As shown schematically for the front dye tube 118DF, dye may be continuously recirculated through the dye tube 118DF by means of a pressure relief valve 180, a dye tank 182, and a pump 184. When the valves 132 are cut off, the pressure relief valve 180 will open allowing excess pressure in the dye conduit or tube 118DF to be relieved with the dye flowing into the dye tank 182. Dye from the tank 182 is continuously fed into the dye tube 118DF by the pump 184. Although not shown in the drawings, a similar recirculation system may be used in conjunction with the dye tube 118DF. Preferably, the dye conduit 118DB and 118DB are realized by three independent manifolds which extend across the width of the carpet (i.e., perpendicular to the plane of FIG. 5). Alternately, one could consolidate the two dye tubes 118DF and 118DB as a single dye tube.

Figure 6:
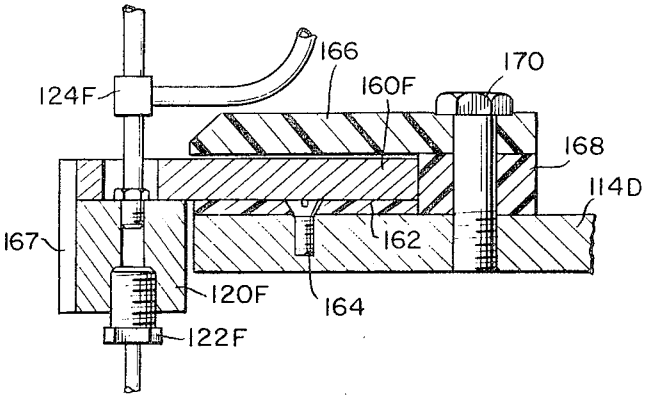
FIG. 6 shows an enlarged cross section side view of a part of the FIG. 5 embodiment.

Turning now to FIG. 6, the specifics of the mounting of the reciprocating member 160F will be discussed. FIG. 6 shows an enlarged cross sectional view in the same plane as FIG. 5 and with several parts broken away for simplicity.

The structure of FIG. 6 is designed to avoid adverse effects caused by the reciprocation of reciprocating member 160F perpendicular to the plane of FIG. 6. In particular, aluminum reciprocating member 160F should be isolated from aluminum floor or support surface means in order to avoid having aluminum oxides dropping on to the carpet disposed therebelow. Accordingly, a high density linear polyethylene bearing portion 162 is attached to the floor 114D by a nylon (or other non-metallic) screw 164. A polyethylene upper guide means 166 and polyethylene side member 168 are bolted by bolt 170 to the support surface 114D. The side member 168 keeps the nozzle support block 120F, which is fixed to the reciprocating member 160F, sufficiently far from the support surface 114D as to avoid metal to metal rubbing. The upper guide means 166 and side member 168 may extend across the complete width of the carpet (i.e., in the direction perpendicular to the plane of FIGS. 5 and 6) or alternately could be realized by separate pieces at spaced intervals across the carpet width. In order to prevent the support block 120F and the reciprocating member 160F from rubbing against the support block 120B and reciprocating member 160B, a linear polyethylene liner or layer 167 is attached to the side of block 120F and reciprocating member 160F. Liner 167 is disposed between the blocks and forms a low friction slide surface.

The back reciprocating member 160B is preferably constructed as a mirror image of the construction shown in FIG. 6 and also uses linear polyethylene in order to avoid metal rubbing against metal. The various polyethylene parts are preferably made of a high density linear polyethylene such as sold under the trademark TEFLON.

Figure 7:
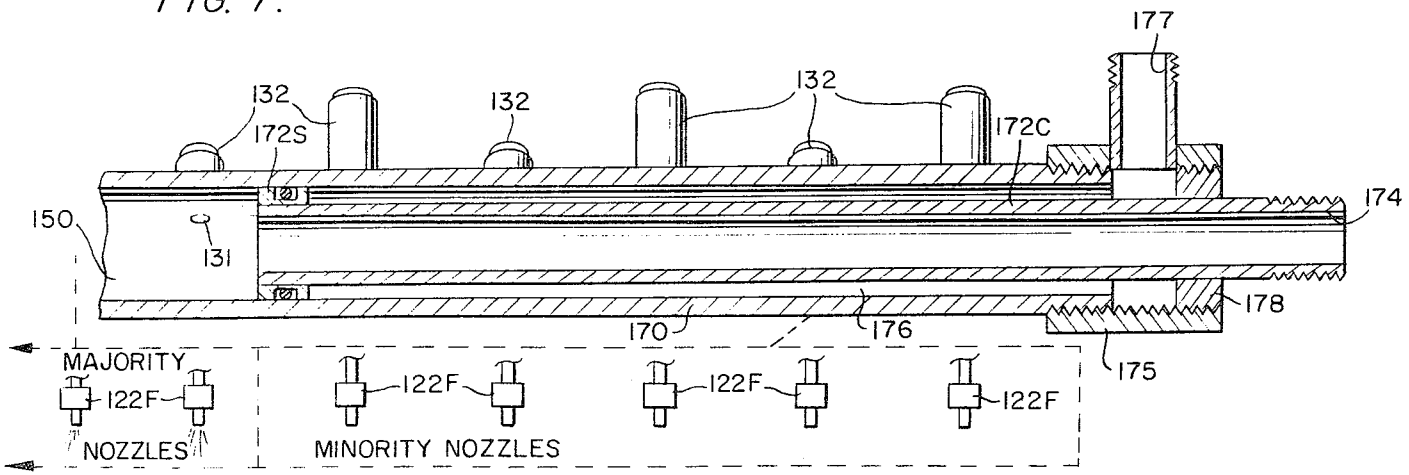
FIG. 7 shows a cross section simplified view along lines 7—7 of FIG. 5 in conjunction with a schematic diagram of spray nozzles.

Turning now to FIG. 7, a width adjustment feature of the present invention will be discussed. FIG. 7 shows a view of the control fluid chamber 150 taken along lines 7—7 of FIG. 5. The end of the control fluid chamber 150 at the left side of FIG. 7 is broken away for simplicity. The control fluid chamber 150 is bounded by an external wall means 170 which is cylindrical as shown. An internal wall means comprising cylindrical portion 172C and end seal portion 172S is disposed at least partly within the external wall means 170 and extends partially out of the external wall means 170 to provide a majority inlet port 174. A collar 175 includes a minority inlet port 177 and is threaded onto the end of the external wall means 170. An interfitting collar 178 screws into the other end of collar 175 to form a sealed annular minority control zone 176 disposed between the cylindrical portion 172C and the cylindrical external wall means 170. The intermediate collar 178 may be welded onto the cylindrical portion 172C of the internal wall means. Alternately, the internal wall means cylindrical portion 172C may slide relative to the intermediate collar 178, thereby allowing internal wall means **172*c* and end seal portion 172S to be slid to the right bringing the end seal portion 172S closer to the intermediate collar 178 and thereby decreasing the length of annular minority control zone 176**.

Each of the valves 132 has an associated channel or hole 131 (only one shown) extending through the wall 170 at the location where the valve is mounted. Depending upon the pressure communicated through the hole to the valve, the valve will be open or closed. Since the holes for the valves mounted to the right of end seal portion 172A communicate with annular minority control zone 176, these valves are open or closed depending on the pressure introduced in minority inlet port 177. The majority of the valves 132 will be mounted to the left of end seal portion 172S and will be open or closed depending on the pressure input to the majority inlet port 174.

As shown schematically in FIG. 7, the minority spray nozzles 122F (and 122B not shown) are controlled by the pressure in minority control zone 176, whereas the majority spray nozzles 122F (and 122B not shown) are controlled by the pressure within chamber 150. By maintaining the pressure high within zone 176, the minority of valves 132 to the right of end seal portion 172S will be closed and the corresponding minority of nozzles 122F (and 122B not shown) will not be spraying dye. However, the majority of nozzles 122F (and 122B) may be turned on to spray dye (as shown) by not feeding pressure into chamber 150. Thus, a narrower field of spray is supplied for dyeing carpet less than the maximum width. Although this width adjustment feature is shown with a majority and a minority of valves which are separately controllable, more generally this could be a first group of valves and a second group of valves.

Figure 8:
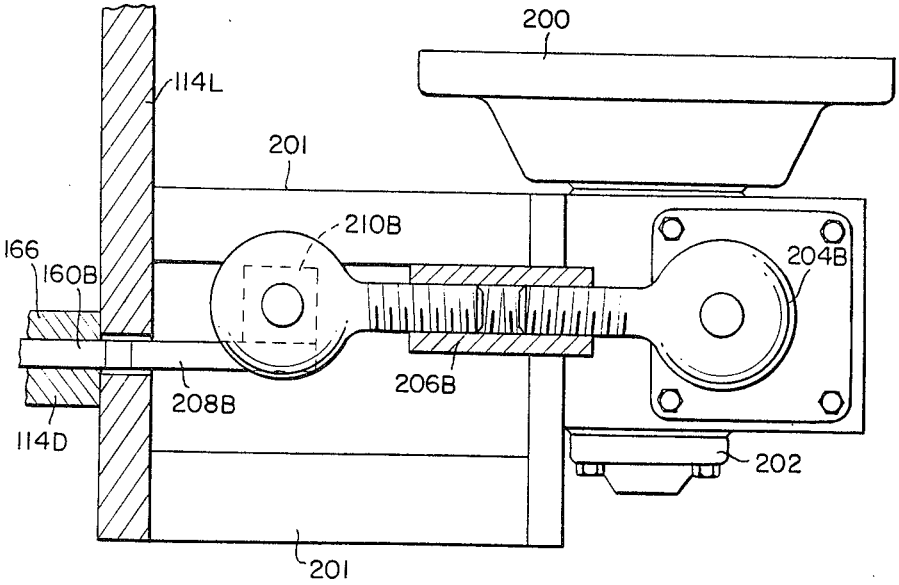
FIG. 8 shows a back view of a drive mechanism used with the FIG. 5 embodiment of present invention.
Figure 9:
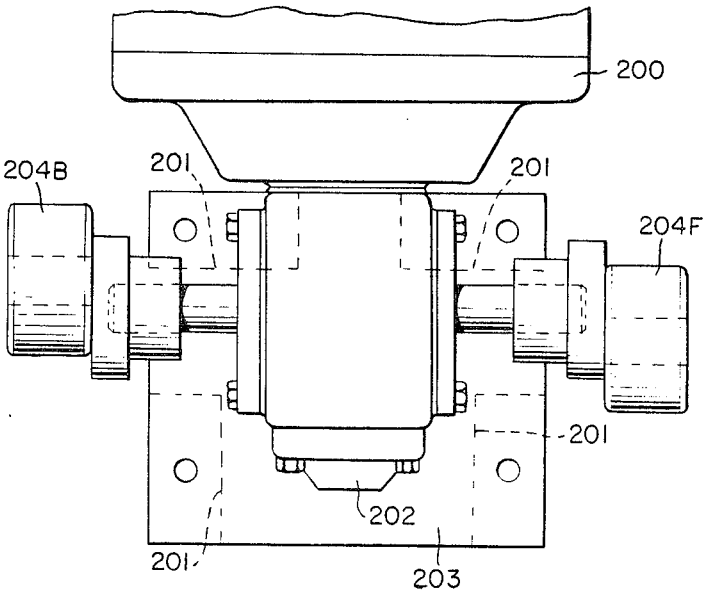
FIG. 9 shows a side view of the drive mechanism.
Figure 10:
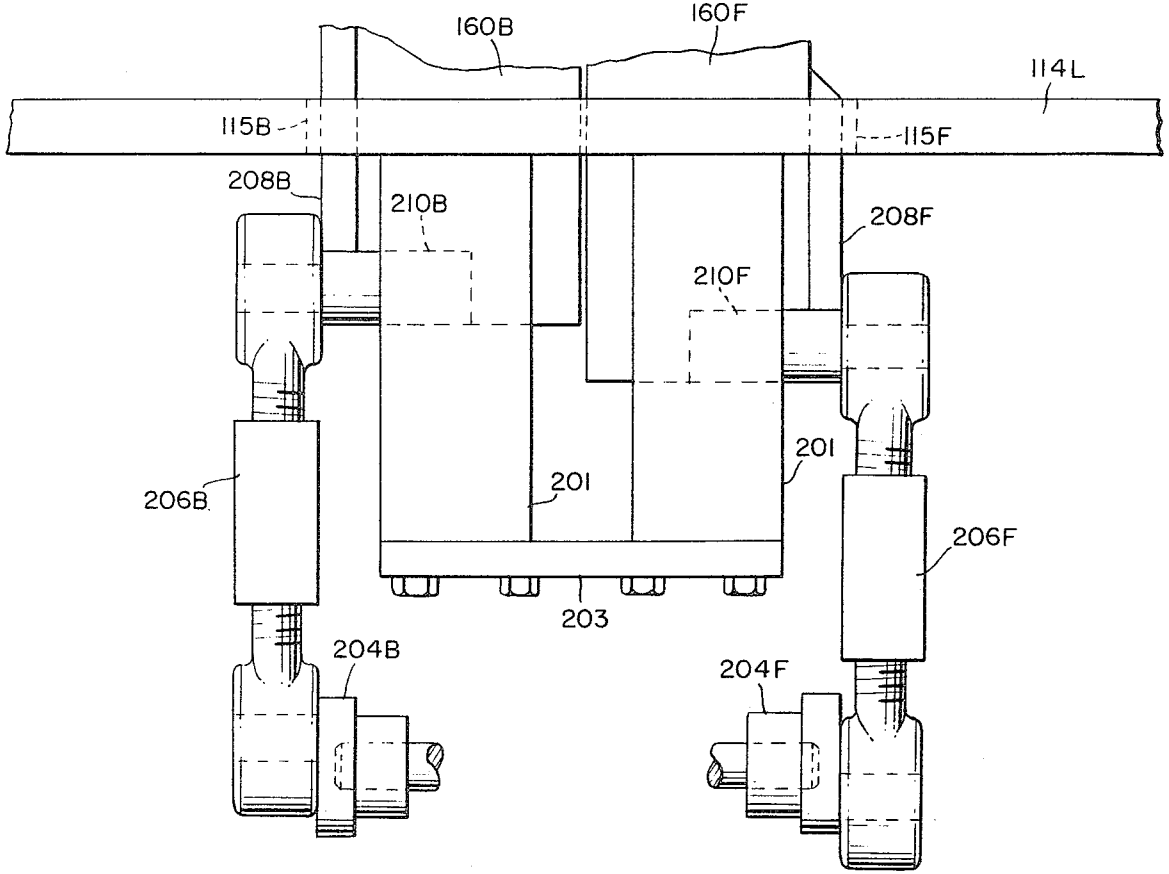
FIG. 10 shows a simplified top view of the drive mechanism.

Turning now to FIGS. 8, 9, and 10, the motor drive arrangement used with the present invention will be discussed. FIG. 8 shows a cross section view taken along lines 8—8 of FIG. 5 with several parts shown broken away. FIG. 9 shows a simplified side view taken in a plane parallel to the plane of FIG. 5, whereas FIG. 10 shows a simplified top view.

A left wall 114L extends between the left end (as viewed looking from the front 114F towards the back 114B of FIG. 5) extends between the front wall 114F and back wall 114B. The front and back reciprocating members 160F and 160B extend through the left wall 114L in the space between the phantom lines 115F and 115B (FIG. 10). High density linear polyethylene (Teflon) bearing portions 208F and 208B protect against metal to metal frictional contact.

A dc motor 200 and associated gear box 202 are mounted to wall 114L by support plate 203 spaced from wall 114L by four support members 201. The gear box 202, which preferably has a gear ratio of five to one, drives the output eccentric cams 204F and 204B.

The eccentric cam 204B drives the reciprocating member 160B by way of an adjustable length link 206B which has one end secured to a block 210 welded or otherwise fixed to the reciprocating member 208. By adjusting the length of the link 206B, one can change the reciprocation stroke between about $\frac{5}{8}$ of an inch and $1\frac{1}{2}$ inches. As best shown in FIG. 10, which is simplified by not including the motor 200 and generator 202 mounted on their support plate 203, the eccentric cams 204F and 204B are out of phase with respect to each other. In particular, they are 180° out of phase such that when one reciprocating member is at its closest point to the motor 200, the other reciprocating member is at its furthest point from the motor. The motor 200 may be a $\frac{1}{2}$ horsepower motor sufficient to rotate the cams at 350 rpm, although different speeds may be used to produce different effects.

SOLID COLOR DYEING OPERATION

The operation of the embodiment shown in FIGS. 5–10 will now be discussed. The basic operation of the FIG. 5 embodiment is similar to that of FIG. 1 in that carpet will be moving from the front (right side of FIG. 5) to the back (left side of FIG. 5) underneath the two rows of spray nozzles including 122F and 122B. Unlike the stationary nozzles of the FIG. 1 embodiment, the rows of nozzles 122F and 122B will reciprocate perpendicular to the plane of FIG. 5.

No dye will flow into the mixing chambers 124F and 124B as long as the dye valves 132 remain closed. Since the dye valves 132 are normally open valves, control fluid pressure such as gas at 60 p.s.i. is maintained within the control fluid chamber 150 and the minority control zone 176. Specifically, an electrical control valve similar to 34 in FIG. 2 is held open to allow the pneumatic high pressure air into the majority inlet port 174 (FIG.7). Likewise, a similar electrical valve allows high pressure gas into the minority control zone 176, thereby maintaining the valves 132 closed. Accordingly, the mixing chambers 124F and 124B are receiving air but no dye. The spray nozzles 122F and 122B are simply spraying air.

Assuming that one is dyeing a relatively narrow carpet or textile web, dyeing is started by closing the electrical control valve (not shown) which allows pressurized fluid flow into the majority inlet port 174. This drop of pressure allows all of the valves 132 to turn on except for those valves to the right (as seen in FIG. 7) of the end seal portion 172S. Since pressurized fluid is still supplied through the minority inlet port 177 into the minority control zone 176, those valves 132 which are mounted to the right of 172S will remain closed.

Once the majority of the valves 132 are gated open, the majority of the mixing chambers 124F and 124B will begin to receive dye which in turn will be sprayed out of the corresponding spray nozzles 122F and 122B in the form of a fine mist foam. The dye valves 132 correspond on a one to one basis with mixing chambers 124F and 124B, each dye valve valving the input to a particular one of the mixing chambers. Further, each mixing chamber 124F corresponds on a one to one basis with a particular spray nozzle 122F and, likewise, each mixing chamber 124B corresponds on a one to one basis with a spray nozzle 122B. Accordingly, when the majority of the dye valves 122 are gated open, the corresponding majority of the spray nozzles 122F and 122B will start spraying a mixture of dye and air. However, those minority of spray nozzles 122F and 122B which receive dye by way of the minority valves (those to the right of 172S) will not be spraying dye since these minority valves are located at the side of the dye applying station, the field of spray out of the nozzles 122F and 122B is adapted for spray dyeing a relatively narrow carpet.

If a relatively wider carpet is to be dyed, the pressurized fluid is cut off from the annular minority control zone 176, thereby allowing the minority valves 122 and their corresponding spray nozzles 122F and 122B to turn on. This produces a wider field of spray which will cover a wider carpet.

As an example, if the spray nozzles 122F and 122B are spaced with a center-to-center distance of $\frac{1}{2}$ inch (other distances could be used), an 18 foot carpet width would correspond to 18 feet$\times$12 inches/ft.$\times$2 nozzles/inch=432 nozzles in each row of nozzles 122B and 122F. If the last six nozzles in each of the rows are connected to valve 132 controlled by the pressure of minority control zone 176, keeping these minority valves off would correspond to a reduction in the field of spray by 6 nozzles$\times\frac{1}{2}$ inch=3 inches.

If one wished to only dye the relatively wider carpet, the collar 175 (FIG. 7) could be removed from the cylindrical external wall means 170 and the internal wall means 172 and 176 could be removed. Accordingly, a single source of valved pressurized fluid could be supplied to control all of the valves mounted on the external wall means 170. Alternately, one could adjust the field of spray in variable steps by sliding the cylindrical portion **172*c* to the right in FIG. 7, thereby decreasing the number of dye valves 132 to the right of portion 172S**.

In order to enhance dyeing of the carpet completely, the rows of spray nozzles corresponding to 122F and 122B are oscillated across the width of the carpet and transverse to its direction of movement. In particular, the motor 200 drives the reciprocating members 160F and 160B by way of the corresponding adjustable links 206F and 206B, eccentric cams 204F and 204B and gear box 202.

Although the present system is especially well adapted for solid color dyeing, different color dyes could be used in the dye supply conduits 118DF and 118DB in order to produce special effects.

One of the major advantages of the present solid color applicator is that it can be used with one applicator or treating station upstream from another closely spaced like constructed applicator. When one of the applicators is shut down to be cleaned out, the other one can be placed into operation immediately. Since the present solid color dyeing apparatus cuts off almost instantaneously, it is not necessary to use 400 or 500 feet of leader as is common in dye applicators today. Experience has shown that 30 feet or less of carpet leader may be used with the present invention. If changing from one color to another color, one applicator head or treating station is simply turned off and, upon passage of thirty feet or less of leader past the dye head, the applicator head may be switched ON in order to apply a different color dye.

In either the FIG. 1 or FIG. 5 embodiments, the placement of spray nozzle within $2\frac{1}{2}$ inches of the mixing chamber is highly advantageous in minimizing the possibility of the mixed gas and dye from breaking down or degrading in form (e.g. sputtering) between the mixing chambers and the corresponding spray nozzles.

By placing the lower end of the spray nozzles 122F and 122B within $2\frac{1}{2}$ inches of the respective mixing chambers 124F and 124B, the relatively short length of tubing between the mixing chambers and corresponding nozzles cause the mixing chambers to be pulled in movement in phase with the corresponding nozzles as the reciprocating member moves back and forth.

Although various details have been included in the present discussion, it is to be understood that these details are for illustrative purposes only. Numerous modifications and adaptations will be readily apparent to those of ordinary skill in the art. Accordingly, the scope of the present invention should be determined by reference to the appended claims.

What is claimed is:

1. A method of treating a continuously moving textile web, the steps comprising:

(a) conveying the web past at least one treating station; and (b) mixing gas and treating liquid in a plurality of separate mixing chambers disposed at said at least one treating station to create a fine foam spray applied directly onto the web through a plurality of spray nozzles disposed at said at least one treating station and corresponding on a one-to-one basis with said plurality of mixing chambers, each spray nozzle spraying the foam from the corresponding one of said mixing chambers.

2. The method of claim 1 wherein said foam is sprayed out from said spray nozzle within $2\frac{1}{2}$ inches of said mixing chamber.

3. The method of claim 1 further comprising the step of:

reciprocating said plurality of spray nozzles while the mixed foam is sprayed onto the web.

4. The method of claim 1 further comprising the steps of:

operatively connecting a plurality of dye valves to a source of dye to cause dye to flow to said plurality of mixing chambers, and wherein there is one dye valve for each mixing chamber, and said connection of said plurality of dye valves to said source is accomplished simultaneously.

5. The method of claim 4 further including the step of:

reciprocating said plurality of mixing chambers.

6. The method of claim 4 wherein said plurality of spray nozzles are arranged in at least two rows and said reciprocating step includes reciprocating each of said at least two rows out of phase with respect to any other row.

7. The method of claim 6 further including the step of:

reciprocating said plurality of mixing chambers, some mixing chambers reciprocating in phase with each row of said at least two rows.

8. The method of claim 4 wherein said plurality of spray nozzles are arranged in two rows, and said reciprocating step includes reciprocating each row 180° out of phase with respect to the other row.

9. Apparatus for treating a continuously moving textile web comprising:

(a) a plurality of liquid valves;

(b) a plurality of mixing chambers corresponding on a one-to-one basis with said plurality of liquid valves, each mixing chamber having a first input connected to a gas pressure source and a second input connected to the corresponding one of said liquid valves for receiving gas and liquid, respectively, and for mixing gas and liquid to create a foam, (c) a plurality of nozzles for spraying said foam from a corresponding one of said mixing chambers onto a textile web, and (d) reciprocating means for causing said nozzles to reciprocate.

10. The apparatus of claim 9 wherein said plurality of liquid valves are fluid pressure controlled valves mounted on an external wall of a control fluid chamber, said external wall having a through opening at the location of corresponding liquid valve, each liquid valve controlled by the pressure of a control fluid in said control fluid chamber just inside of the corresponding opening.

11. The apparatus of claim 9 further comprising:

an internal wall at least partly within said control fluid chamber for isolating a predetermined number of said liquid valves from the control fluid pressure which controls the remainder of said liquid valves.

12. The apparatus as set forth in claim 11 wherein said predetermined number of liquid valves correspond to and control a predetermined number of said nozzles.

13. The apparatus of claim 9 wherein said mixing chamber is mounted to said reciprocating means such that said reciprocating means causes said mixing chambers to reciprocate.

14. The apparatus of claim 9 wherein said reciprocating means includes two reciprocating members, each of said nozzles being mounted to one of said two reciprocating members.

15. The apparatus of claim 14 further comprising support surface means underlying at least a portion of each of said two reciprocating members for supporting said two reciprocating members above a continuously moving textile web, and upper guide means disposed above at least part of each of said two reciprocating members, and wherein said upper guide means and said support surface means together hold said two reciprocating members against vertical movement.

16. The apparatus of claim 15 further comprising linear polyethylene bearing portions to bear the relative movements as said two reciprocating members reciprocate.

17. The apparatus of claim 14 wherein said plurality of liquid valves are fluid pressure controlled valves and are mounted on an external wall of a control fluid chamber, said external wall having an opening at the location of each corresponding liquid valve such that each liquid valve is controlled by the pressure of a control fluid in said control fluid chamber just inside of the corresponding opening.

* * * * *